US005535823A

United States Patent [19]

Reid

[11] Patent Number: 5,535,823

[45] Date of Patent: Jul. 16, 1996

[54] APPARATUS FOR AMPLIFYING A LOAD

[75] Inventor: Michael A. Reid, Aberdeen, Scotland

[73] Assignee: Well-Equip Limited, Aberdeen, Scotland

[21] Appl. No.: 380,860

[22] Filed: Jan. 30, 1995

[30] Foreign Application Priority Data

Jan. 29, 1994 [GB] United Kingdom ..... 9401732

[51] Int. Cl.[6] ..... E21B 23/02

[52] U.S. Cl. ..... 166/123; 166/72

[58] Field of Search ..... 166/123, 124, 166/125, 72, 66.4

[56] References Cited

U.S. PATENT DOCUMENTS

| | | | |
|---|---|---|---|
| 3,670,821 | 6/1972 | Tamplen | 166/125 |
| 4,043,390 | 8/1977 | Glotin | 166/125 X |
| 4,116,274 | 9/1978 | Rankin et al. | 166/66.4 |
| 4,598,774 | 7/1986 | Nevels et al. | 166/124 X |
| 4,838,594 | 6/1989 | Bullard | 166/125 X |
| 5,133,404 | 7/1992 | Dollison | 166/72 |

*Primary Examiner*—Hoang C. Dang

*Attorney, Agent, or Firm*—Popham, Haik, Schnobrich & Kaufman, Ltd.

[57] ABSTRACT

Apparatus (50) for amplifying a load applied by a wireline to a tool in a borehold includes a housing (4). A first coupling device (51) couples the wireline to the apparatus (50) and a second coupling device (60) couples the tool to the apparatus (50). The second coupling device (19) is movably mounted within the housing (4) and the transmission mechanism (9, 14,16) interconnects the first and second coupling devices. The transmission mechanism permits a mechanical advantage and comprises a first linearly movable member (9) coupled to the first coupling device (51) and a second linearly movable member (16) coupled to the second coupling device (19). The first and second members (9, 16) are interconnected by a rotatable member (14) such that movement of the first member (9) rotates the rotatable member (14) to move the second member (16). The movement of the second member (16) is less than the movement of the first member (9) and so the apparatus (50) generates a mechanical advantage.

8 Claims, 14 Drawing Sheets

APPARATUS FOR AMPLIFYING A LOAD

The invention relates to apparatus for amplifying a load and, in particular, apparatus for use with wireline operations downhole in an oil or gas well.

BACKGROUND OF THE INVENTION

Wireline is a method of lowering specialised equipment into an oil or gas well, or raising specialised equipment from an oil or gas well. The principle of wireline is to attach a workstring or toolstring to the end of a reel of wire and by reeling out the wire the toolstring is lowered into the well. By either reeling in or reeling out the wire, the toolstring can be made to perform simple tasks downhole.

Wireline operations are frequently performed in live high pressure wells. The wireline used is mainly single strand high tensile wire (slick-line wireline), although multi-strand cable is also used to a lesser extent. An obvious problem however is that the wireline must be allowed to run free in the well and at the same time the well pressure must be contained. This is generally achieved by running the wire through a device known as a "Stuffing Box" for a single strand wireline, or through a device known as a "Grease Injection Head" for a multi-strand wireline.

Both methods involve setting up pressure control equipment at the surface which is connected directly onto the wellhead. However, equipment used to run a multi-strand wireline is more complex and expensive than the equipment used to run a single strand wireline. However, the advantage of running a multi-strand wireline is that it allows a greater pulling force to be achieved. Typically, this is about one and a half times as much force as can be pulled using a comparable single strand wireline. The expense of using a multi-strand wireline means that the weaker single strand wireline is most commonly used in wireline operations.

A further problem with conventional wireline operations is that force applied by the winch at the surface is greatly diminished at the toolstring, especially at great depth, due to wire stretch.

One of the most common operations performed by slick-line wireline is to set a series of plugs into the well-bore to hold back the natural flow of the well. This is done to enable flow control valves at the surface, that is the Xmas Tree, to be removed or repaired etc. safely. The plugs used are of a type which are designed to be located into a "landing nipple" which corresponds to each plug. The landing nipple consists of a "no-go" shoulder to land on and a recess for the plug to lock into.

The landing nipples are an integral part of the tubing string and are incorporated at various depths by the requirements of the Petroleum Engineer at the time of well completion. After a duration of time and depending on the sand content of the production fluid the landing nipple become "washed out". That is the "no-go" shoulder and recess are eroded away, when this occurs it is impossible to install a conventional plug. This condition is becoming a very common occurrence in oil wells in the North Sea.

A "washed-out" nipple system on a tubing string poses a very obvious problem to the operator, that being, how to install plugs to carry out the maintenance etc., as described above. At present there is only one answer to this problem, this being, to install electrically set bridge plugs. Bridge plugs can be installed anywhere in the tubing string by means of a toothed slip mechanism which allows these plugs to grip the internal diameter of the tubing. A compression sealing element seals against the internal diameter of the tubing thus forming the plug. A chemical charge is detonated by an electrical impulse sent through the cable and this detonation energises the setting mechanism downhole, to perform the setting process.

However, electric line methods incur high costs to the operator which means that setting bridge plugs is a very costly exercise. In addition, the force required to compress the sealing element increases as the sealing element is compressed but with a chemical charge which is detonated the maximum amount of compression force on the sealing element occurs at the initial detonation of the charge and decreases as the amount of compression force required to compress the sealing element increases. Hence, using a chemical charge is a relatively inefficient method of activating the bridge plug. There is also the danger of the charge being detonated inadvertently, for example by signals from radio or by electrical noise from other equipment on the rig. Hence, the handling and use of this type of equipment can be dangerous, especially in an offshore environment where there may be a high fire risk.

SUMMARY OF THE INVENTION

In accordance with the present invention apparatus for amplifying a load applied by a wireline to a tool in a borehole comprises a housing, a first coupling device to couple the wireline to the apparatus, a second coupling device to couple the tool to the apparatus, the second coupling device being movably mounted within the housing, a transmission mechanism interconnecting the first and second coupling devices, the transmission mechanism permitting a mechanical advantage and comprising a first lineraly movable member coupled to the first coupling device and a second linearly movable member coupled to the second coupling device, the first and second members being interconnected by a rotatable member such that movement of the first member rotates the rotatable member to move the second member, the movement of the second member being less than the movement of the first member to generate a mechanical advantage.

Preferably, the first coupling device is movable relative to the housing.

Preferably, the rotatable member is mounted on the first member by a helical formation associated with the first member, and typically also includes a bearing.

The rotatable member is typically coupled to the second member by a bearing means and/or another helical formation. Preferably the rotatable member is coupled to the second member by a bearing means and another helical formation.

Typically, the other helical formation has a pitch which is less than the pitch of the helical formation associated with the first member. Typically, the pitches may have a ratio of, for example, 23:1. This would generate a mechanical advantage, or load amplification , of 23 times. The pitch of the helical formation associated with the first member may be, for example, 50 mm.

Typically, the rotatable member may comprise a bearing device which engages a helical formation on the first member. The rotatable member may have a helical formation which engages a complimentary formation on the second member, or alternatively on the housing or a member coupled to the housing. Alternatively, the rotatable member may comprise another bearing device which engages a helical formation on the second member.

It is possible that the helical formations may be provided on the rotatable member and the bearings on the first and second members.

Preferably, the apparatus is adapted to be used in conjunction with a "bridge plug" (or "Seal Bore Packer System") and preferably , the apparatus provides sufficient amplification of the load applied to the wireline to activate the bridge plug and compress the sealing element.

It would be possible to use two or more sets of apparatus in series so that the load applied to the wireline is amplified once and then the amplified force is further amplified. However, it may be preferable to further amplify the load applied to the first member by increasing the ratio of movement of the first member to movement of the second member. Where helical formations are used this would be done by increasing the ratio of the pitches.

By using such a system it is possible to apply for example a 1000 lbs to 1200 lbs load to the wireline and obtain an amplification of 23000 lbs which is sufficient to initiate compression of the elastomer sealing element of the bridge plug.

Alternatively, the apparatus may be used with a jar mechanism to amplify the pulling force applied to the jar mechanism to obtain a higher jarring force. In this case the apparatus and jar mechanism could be combined into a single housing or be two separate items joined together by an operator prior to use.

The apparatus may also be used with other wireline tools in order to obtain an amplification of the force exerted by the wireline on the wireline tool.

BRIEF DESCRIPTION OF THE DRAWINGS

Examples of apparatus for amplifying a load in accordance with the invention will now be described with reference to the accompanying drawings, in which.

DESCRIPTION OF PREFERRED EMBODIMENTS

Figure 1:
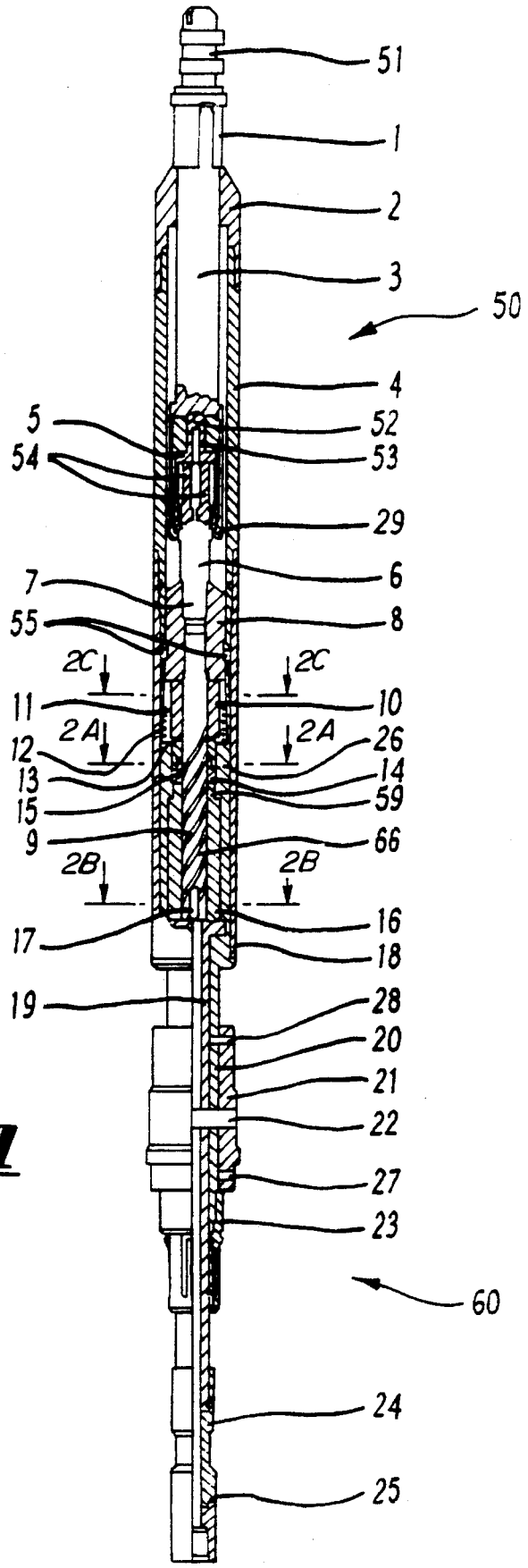
FIG. 1 is a partial cross-sectional view of a first example of load amplifying apparatus coupled to a running tool.

FIG. 1 shows a load amplifier 50 which has a connector 51 at its upper end for connecting the load amplifier 50 to a wireline (not shown) for running the load amplifier 50 into a tubing string in a wellbore. The connector 51 forms part of a connector sub 1 which is attached by a screw thread to a latch mandrel 3. The latch mandrel 3 has a recess 52 in which a piston section 53 of a latch member 5 is located. A number of fingers 54 depend from the piston section 53 and each finger 54 has a shoulder 29 formed on its lower end. The shoulders 29 may be engaged with the top end of a connection head 6.

Coupled to the lower end of connection head 6, by a shear pin 7, is a locking sub 8 which is connected by a screw thread to the top end of a lead screw 9. Mounted on the lead screw 9 is a nut 14, which has a number of ball bearings 15 which engage in a helical screw formation 66 on the lead screw 9.

The helix angle of the screw formation 66 is such that the lead screw 9 can be easily pulled through the nut 14 and if the lead screw 9 is prevented from rotating, pulling the lead screw 9 through the nut 14 results in rotation of the nut 14. The nut 14 has a fine thread 65 cut into its outside diameter which engages in a corresponding thread on a drive sub 26. The drive sub 26 has a number of sprung fingers 55 extending upwardly from the drive sub 26 with shoulders 56 formed on the end of each finger 55.

Figure 2A:
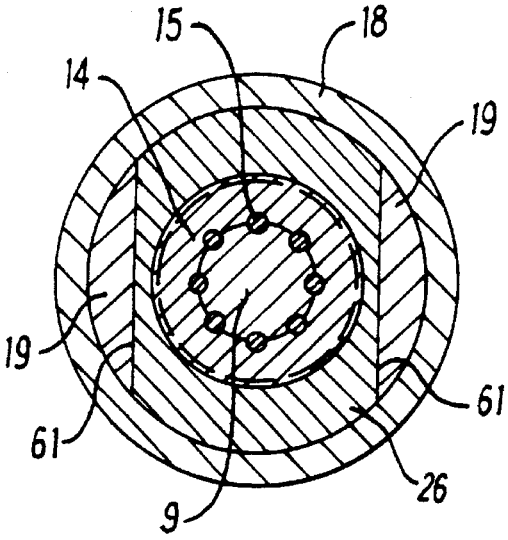
FIGS. 2A, 2B and 2C show cross-sectional views through the load amplifying apparatus of FIG. 1 on the lines AA, BB and CC respectively.
Figure 2C:
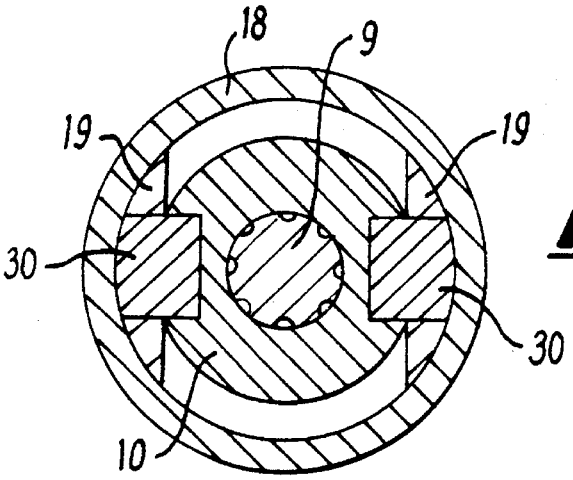
Figure 3:
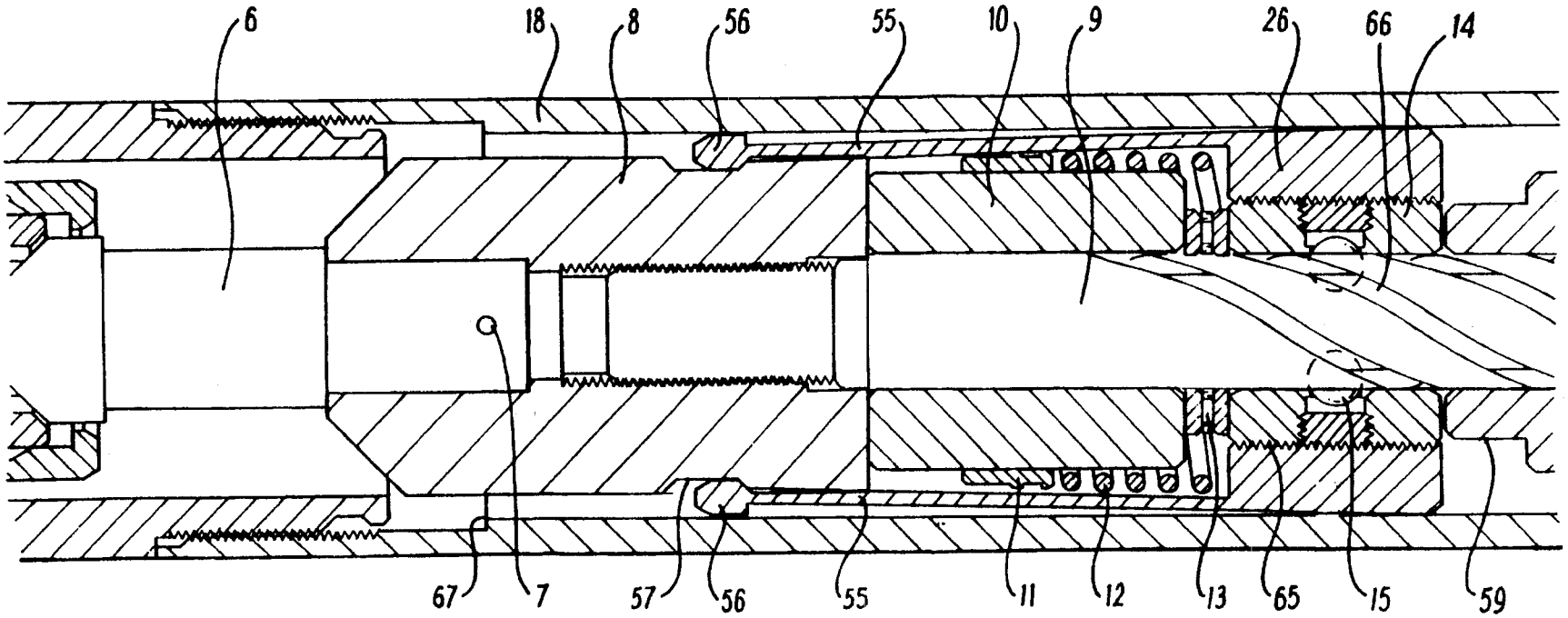
FIG. 3 is an enlarged cross-sectional view of a portion of the load amplifying apparatus shown in FIG. 1.

In the position shown in FIG. 1, the shoulders 56 engage a recess 57 in the external surface of the locking sub 8 (see also FIG. 3). Above the nut 14, a thrust bearing 13 provides a coupling between the nut 14, which is rotatable, and a support bush 10, which is non-rotatable. A cross-sectional view through the support bush 10, on the line CC of FIGS. 1 and 3, is shown in FIG. 2C. It can be seen from FIG. 2C that the support bush 10 is attached to a screw housing 19 by pins 30 so that the screw housing 19 moves with the support bush 10. The screw housing 19 extends down both sides of the lead screw 9.

Located in between the fingers 55 and the support bush 10 are a helical spring 12 and a sleeve 11.

Figure 2B:
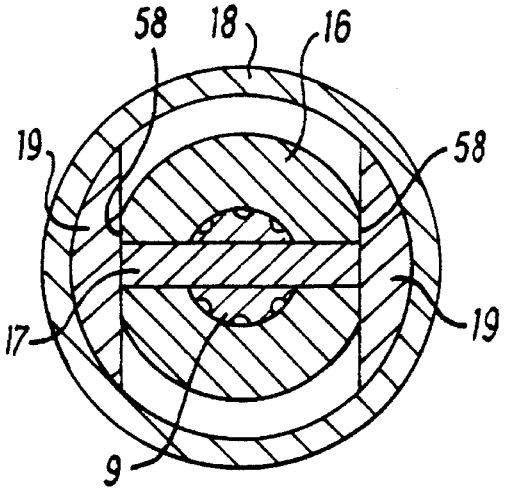

FIG. 2B is a cross-sectional view on the line BB in FIGS. 1 and 3 and shows a pin 17 through the lower end of the lead screw 9. The pin 17 is mounted in a vertical slot in a torque arrestor sub 16 so that the lead screw 9 may move vertically with respect to the torque arrestor sub 16, but due to the presence of the pin 17, the lead screw 9 may not rotate with respect to the torque arrestor sub 16. Also, the torque arrestor sub 16 has diametrically opposed flat sides 58 which abut against the inside of the screw housing 19 to prevent rotation of the torque arrestor sub 16 relative to the screw housing 19, as shown in FIG. 2B.

The torque arrestor sub 16 is profiled at its upper end 59 so that the upper end 59 is of approximately the same diameter as the external diameter of the nut 14, so that top end 59 may enter the threaded bore of the drive sub 26.

All the above components are encased in a housing which comprises an upper body 2, intermediate body 4, a middle body 18 and a lower body formed by drive sleeve 20.

Attached to the lower end of the screw housing 19, which extends down through the drive sleeve 20, is a running tool 60. The running tool 60 has an upper body 21 which is secured to the screw housing 19 by a pin 22 which movably located in a vertical slot through the drive sleeve 20. In the initial running in position shown in FIG. 1, the body 21 is also secured to the drive sleeve 20 by a shear pin 28.

Figure 6:
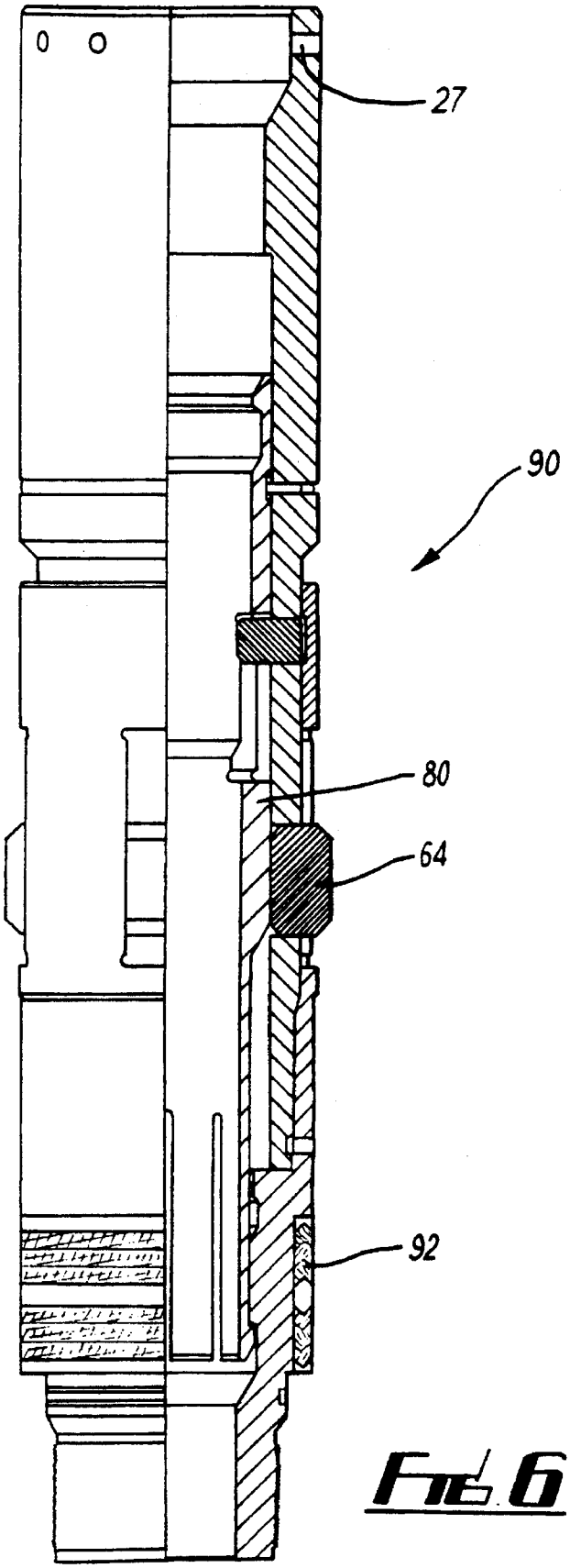
FIG. 6 is a partial cross-sectional view through a lock mechanism which may be coupled to the running tools shown in FIGS. 1, 4, 5 and 7.

Attached to the lower end of the screw housing 19 is a running tool lower sub 24. The running tool 60 is typically coupled to a lock mechanism 90, such as that shown in FIG. 6, by means of shear pins 25, 27. Attached to the lower end of the drive sleeve 20 is an expander mandrel 23 which when moved downwards within the lock mechanism 90 causes the dogs 64 to move out to the position shown in FIG. 6 to lock the lock mechanism 90 to a nipple (not shown) in a tubing string by pushing the expander sub 80 of the lock mechanism 90 downwards to the position shown in FIG. 6.

FIG. 2A is a cross-sectional view along the line AA in FIG. 1 and shows that the drive sub 26 has flat sides 61 which engage with the sides of the screw housing 19 and therefore prevent rotational movement of the drive sub 26 with respect to the screw housing 19.

In operation, the apparatus is run into a tubing string in a well bore with the load amplifier 50 in the position shown in FIG. 1. That is, the latch member 5 is disconnected from the connection head 6, and the lead screw 9, screw housing 19 and nut 14 are at their lowest positions in the load amplifier 50.

Once the apparatus is lowered and the lock mechanism 90 contacts a no-go shoulder in the nipple in which the lock mechanism 90 is to be secured, downward jarring applied by conventional jar mechanisms in the tool string shear the shear pins 28, permitting the drive sleeve 20 to move downwards with respect to the screw housing 19 and body 21 so that the expander mandrel 23 moves the dogs 4 outwards to lock the lock mandrel 90 to the landing nipple.

Figure 4:
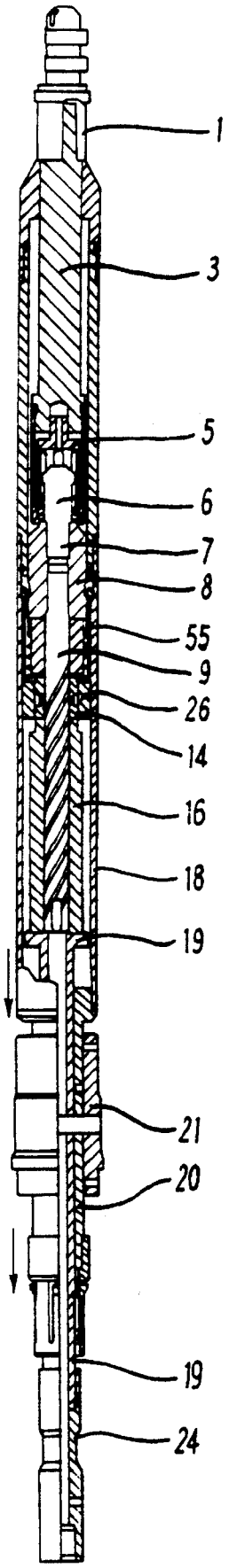
FIG. 4 is a partial cross-sectional view similar to the view shown in FIG. 1, but with the apparatus in a setting position.
Figure 5:
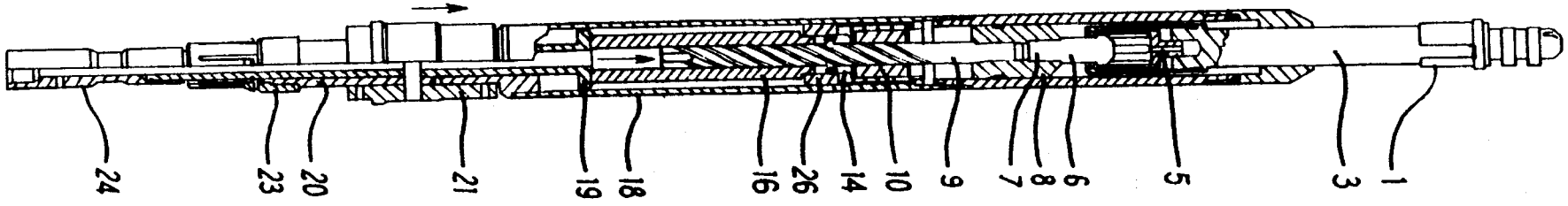
FIG. 5 is a partial cross-sectional view similar to the view shown in FIG. 1, but with the apparatus in a compressing position.

This downward movement of the drive sleeve 20 causes the drive sub 26 to move upwards with respect to the middle body 18 so that the shoulders 56 on the fingers 55 engage shoulder profile 67 on the inside of the middle body 18, as shown in FIG. 4. The sleeve 11 also moves upwards to engage the inside surface of the shoulders 56 to support shoulders 56 and maintain the shoulders 56 engaged with profile 67. In this position, the connection head 6 has entered the latch member 5 so that upward movement of connector 51 causes upward movement of the latch mandrel 3, hence pulling the connection head 6, locking sub 8 and lead screw 9 upwards, as shown in FIG. 5.

Upward movement of the lead screw 9 causes rotation of the nut 14 and, because the thread 65 on the external side of the nut 14 is in the opposite direction to the direction of the helix formation 66 on the lead screw 9, and the drive sub 26 is prevented from moving downwards as the shoulders 56 are engaged in the profile 67, rotation of the nut 14 causes upward movement of the nut 14 against the thrust bearing 13 so moving the support bush 10 upwards. As the support bush 10 is pinned to the screw housing 19 by pins 30, upward movement of the support bush 10 pulls the screw housing 19 upwards which pushes the torque arrestor sub 16 upwards so that the profiled end 59 of the torque arrestor sub 16 enters the threaded bore in the drive sub 26.

Upward movement of the screw housing 19 pulls the lower sub 24 of the running tool 60 upwards to compress the lock mechanism 90 between the expander mandrel 23 and the shear pin 25, which couples the lower sub 24 to the lock mandrel 90. This compression force causes compression of sealing element 92 on the lock mechanism 90 causing the sealing element 92 to expand outwardly and seal within the landing nipple.

Shear pin 25 can be rated to shear at a value greater than the force known to compress the elastomer element 92 sufficiently, such that after the sealing element 92 has been compressed and locked in position, the shear pin 25 shears and the load amplifier 50 and running tool 60 can be retrieved leaving the lock mechanism 90 set within the landing nipple.

During the upward jar to remove the running tool from the lock mandrel 90, the shear pin 7 would shear early to disconnect the connection head 6 from the locking sub 8, to help prevent damage to the lead screw mechanism by shock loading.

An advantage of the apparatus is that by providing a lead screw 9 with a helical formation 66 which has a pitch which is a number of times larger than the pitch of the thread 65, the load applied to the connection head 6 through the connector 51 is a corresponding number of times less than the force applied by the screw housing 19 and running tool lower sub 24 to compress the sealing element 92 on the lock mechanism 90.

Typically, the pitch of the helical formation 66 on the lead screw may be 50 mm and the pitch of the thread 65 could be 2.17 mm. This would give a pitch ratio of approximately 23:1 which would mean that, ignoring frictional forces and other losses, compressive loading of the sealing element 92 on the lock 90 would be 23 times as large as the load applied to connector 51. It will also be appreciated that the lead screw 9 will have to move 23 times as far as the movement of the screw housing 19 in order to achieve the load amplification of 23:1.

It is also possible to alter the ratio of the applied load to the load generated, by changing the ratio of the pitches of the helical formation 66 and the thread 65. By changing the direction of either the formation 66 on the lead screw or the thread 65 it would be possible to move the screw housing 19 in the opposite direction.

Figure 7:
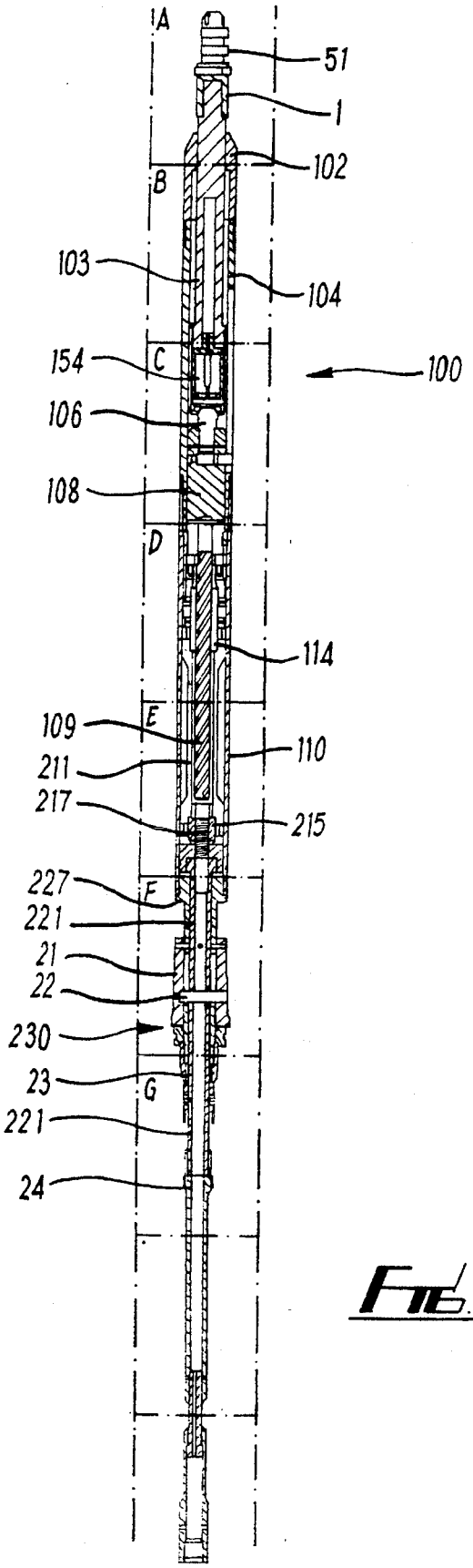
FIG. 7 is a cross-sectional view of a second example of load amplifying apparatus coupled to a running tool.
Figure 8:
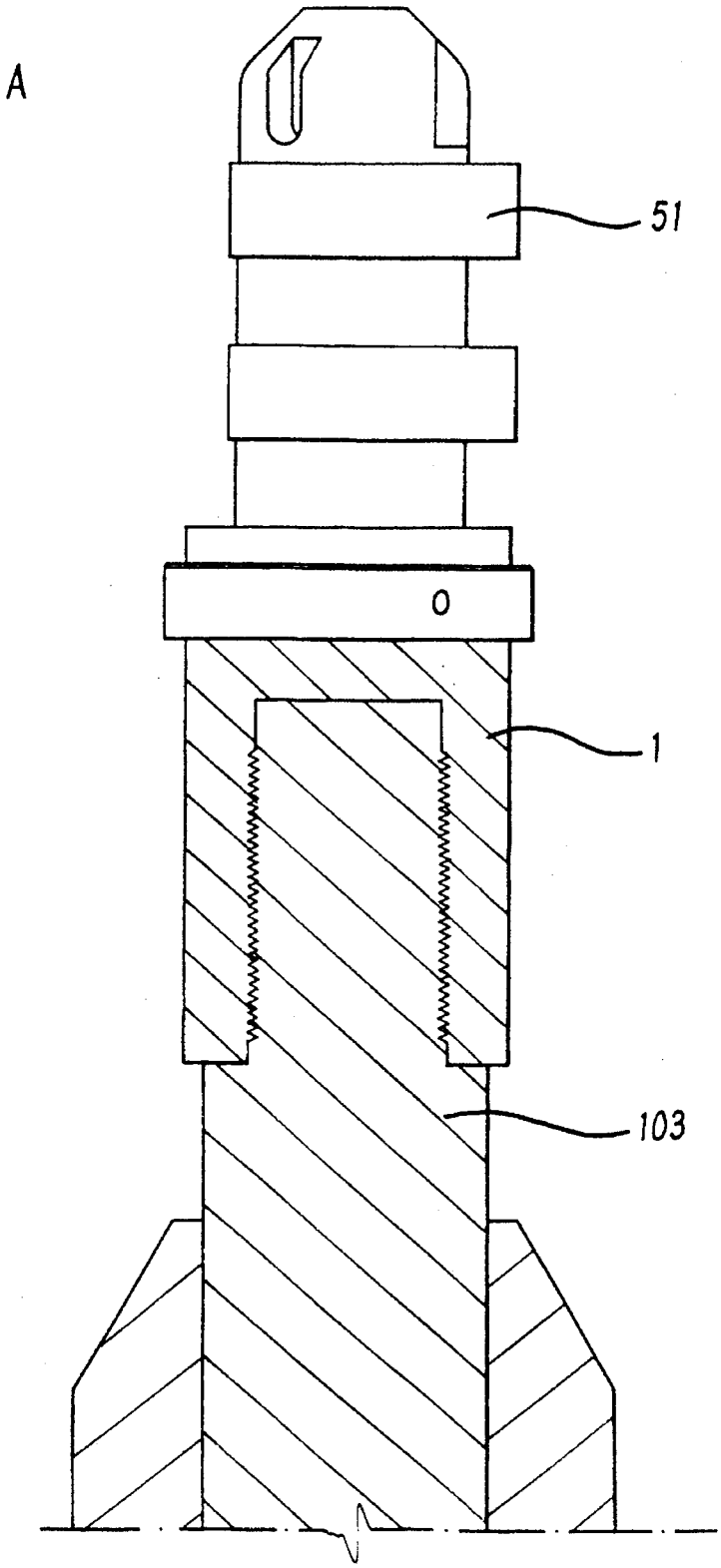
FIG. 8 is an enlargement of the section marked "A" of FIG. 7.
Figure 9:
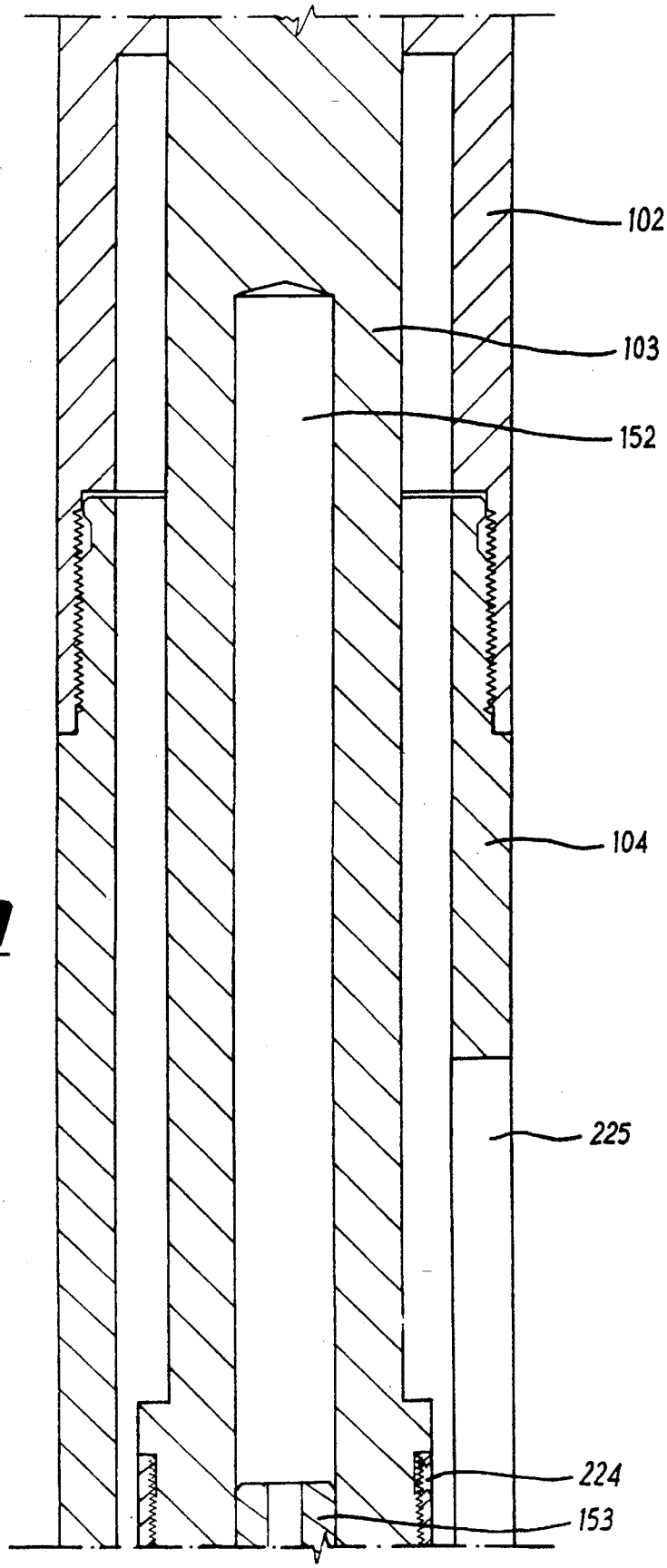
FIG. 9 is an enlargement of the section marked "B" in FIG. 7.
Figure 10:
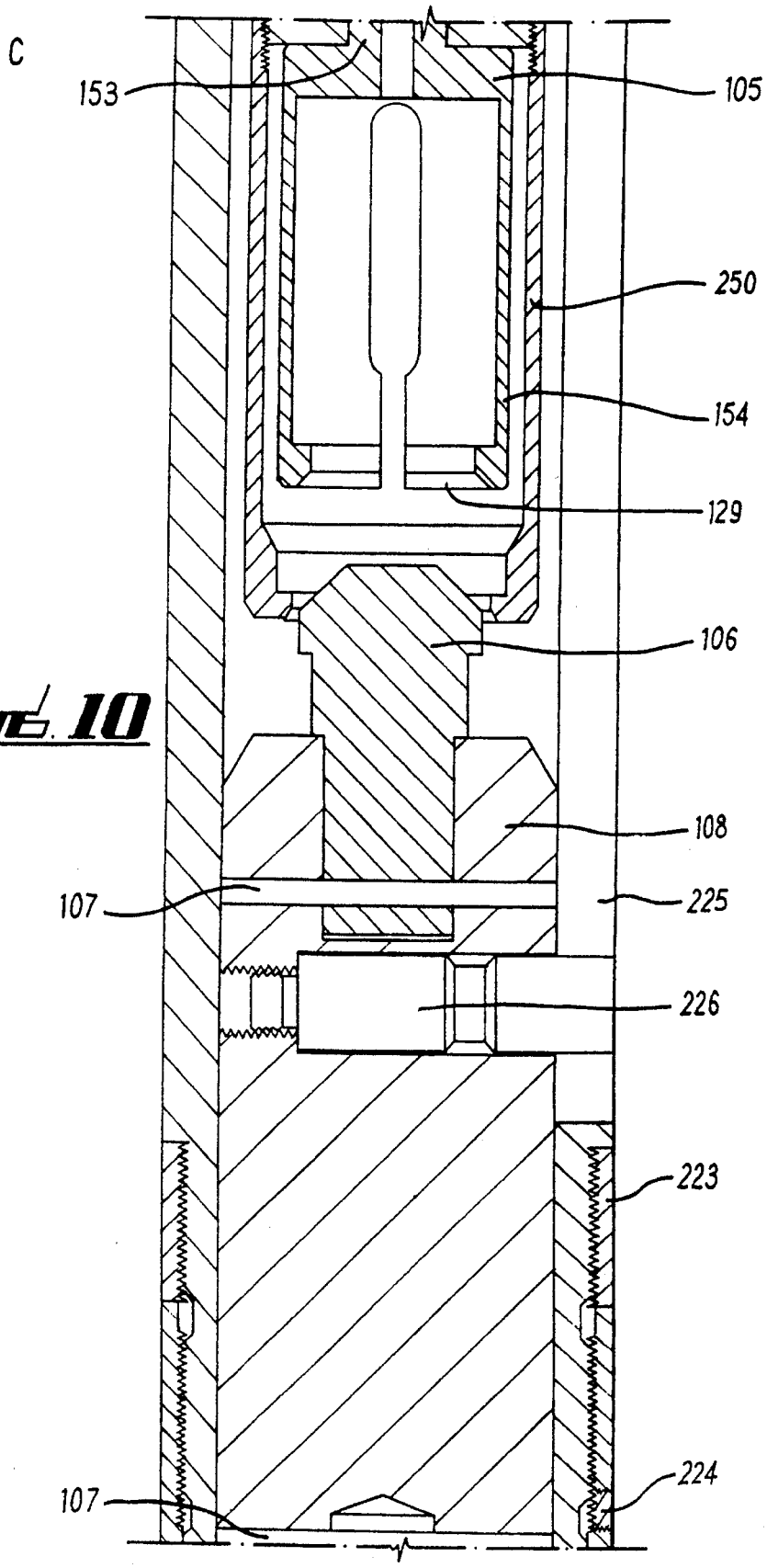
FIG. 10 is an enlargement of the section marked "C" in FIG. 7.

FIG. 7 shows a second example of a load amplifier 100 which has a connector 51 at its upper end for connecting the load amplifier 100 to a wireline (not shown) for running the load amplifier 100 into a tubing string in a well bore. The connector 51 forms part of a connector sub 1 which is attached by a screw thread to latch mandrel 103, as shown in FIG. 8. The latch mandrel 103 has a recess 152 (see FIG. 9) into which a piston section 153 of a latch member 105 is located (see FIG. 10). A number of fingers 154 depend from the piston section 153 and each finger 154 has a shoulder 129 formed on its lower end. The fingers 154 are located within a support housing 250 and the shoulders 129 may be engaged with the top end of a connection head 106.

Figure 11:
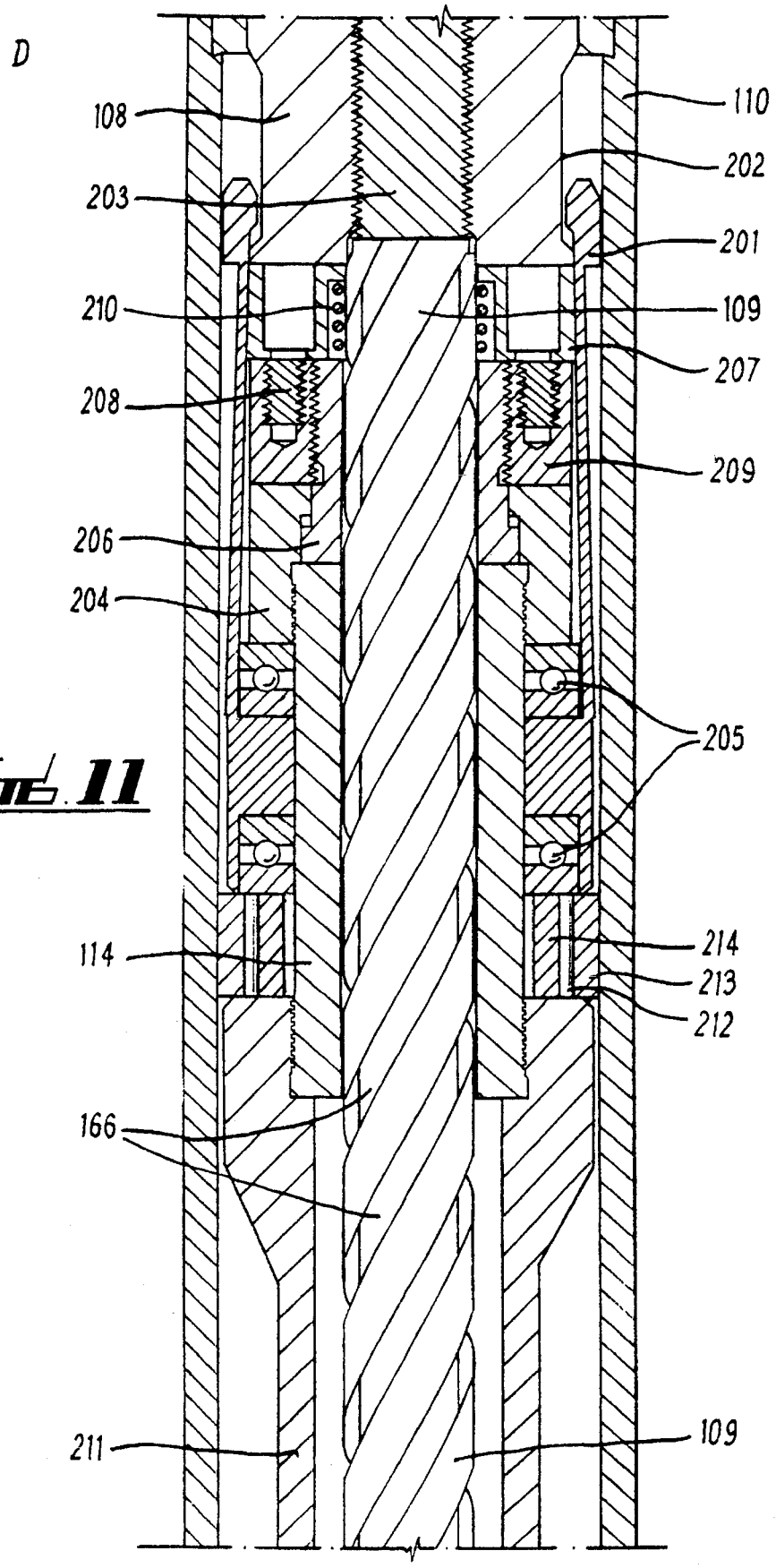
FIG. 11 is an enlargement of the section marked "D" in FIG. 7.

Coupled to the lower end of connection head 106 by a shear pin 107 is a locking sub 108 which is connected by a screw thread to the top end of a lead screw 109 (see FIG. 11). Mounted on the lead screw 109 is a ball nut 114 which has a number of ball bearings (not shown) which engage in a helical screw formation 166 on the lead screw 109. Fixed to the outer surface of the nut 114 is a drive sub 200 which has a plurality of fingers 201 extending upwardly which engage a recess 202 in the lower end of the locking sub 108.

Encasing the latch mandrel 13 is a retainer sub 102 and coupled to the retainer sub 102 is a torque arrestor 104. Coupled to the lower end of the torque arrestor 104 is a middle body 110 which is coupled to the torque arrestor 104 by means a lock ring 223 and a grub screw 224. The torque arrestor 104 has a slot 225 formed along its length and an anti-torque pin 226 located in the locking sub 108 engages with the slot 225 to prevent rotation of locking sub 108 within the torque arrestor 104.

The nut 114 is threadedly coupled at its upper end to an upper retaining bush 204 and a thrust bearing 205 is located between the upper retaining bush 204 and the drive sub 200. Mounted within the upper retaining bush 204 is a swivel bush 206. The swivel bush 206 is attached to a locking ring 207 by means of retainer bolts 208 and a bolt housing 209 which is threadedly attached to the swivel bush 206. A spring 210 is located within the locking ring 207 between the locking ring and the outside surface of the lead screw 109.

At the lower end of the nut 114 a drive shaft 211 is threadedly attached to the nut 114. Between the drive sub 200 and the top end of the drive shaft 211 is a needle bearing 212 with an outer needle bearing ring 213 and an inner needle bearing ring 214. Located between the top of the needle bearing 212 and the drive sub 200 is a thrust bearing 205.

Figure 12:
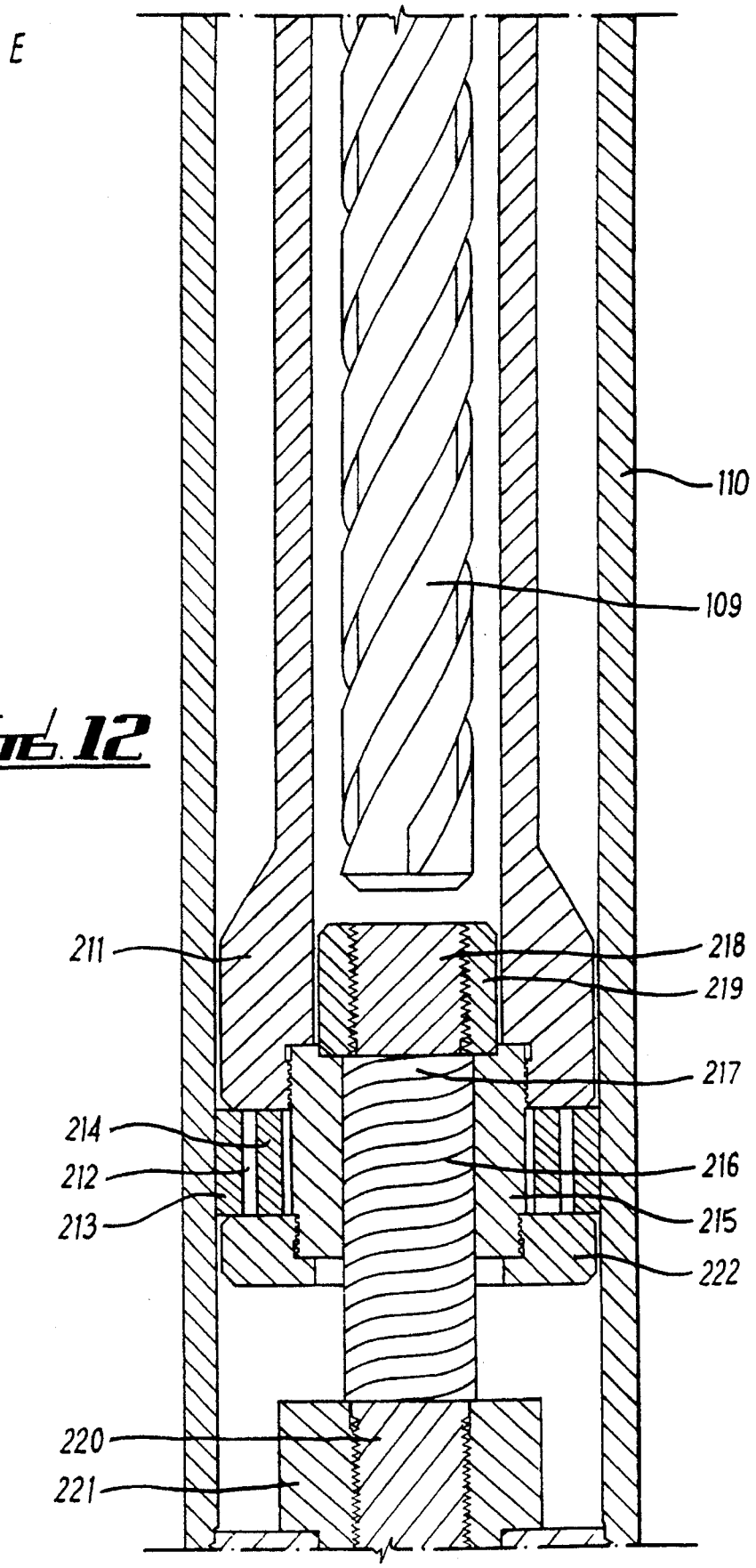
FIG. 12 is an enlargement of the section marked "E" in FIG. 7.

As shown in FIG. 12, the lower end of the drive shaft 211 is attached by a thread to a lower ball nut 215. The lower ball nut 215 is similar to the upper ball nut 114 and has a number of ball bearings (not shown) which engage in a helical screw formation 216 on a lead screw 217. A top end 218 of the lead screw 217 is threadedly attached to limiter bush 219 and the lower end 220 of the lead screw 217 is threadedly attached to a compression shaft 221. The lower end of the nut 215 has a lower retainer bush 222 attached to it by a thread and located between a lower end of the drive shaft 211 and the lower retainer bush 222 is a second needle bearing unit which includes needle bearing 212 and an inner ring 214 and an outer ring 213.

Figure 13:
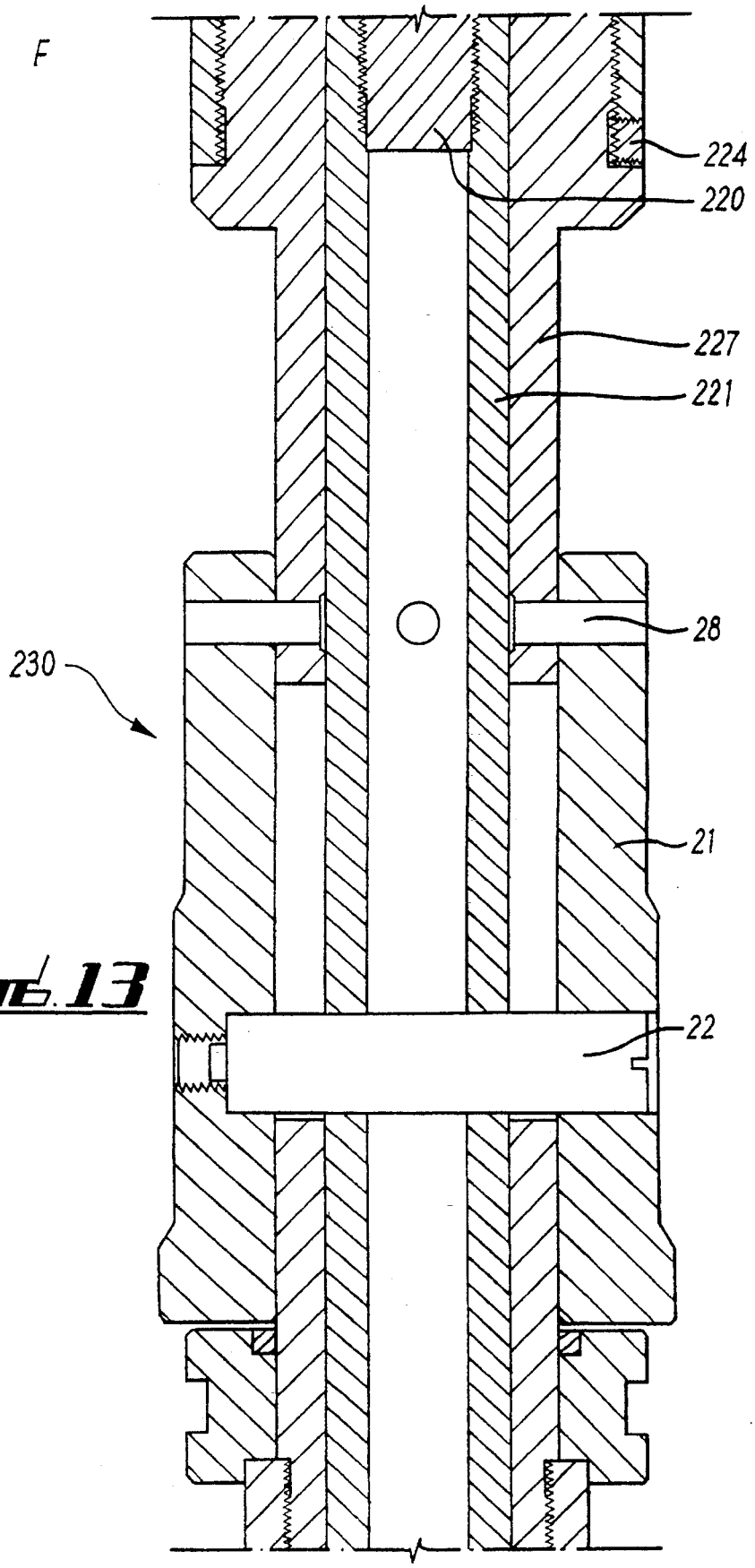
FIG. 13 is an enlargement of the section marked "F" in FIG. 7.

At the lower end of the middle body 110, a drive sleeve 227 is threadedly attached to the middle body 110 and secured in place by means of a grub screw 224 as shown in FIG. 13.

Figure 14:
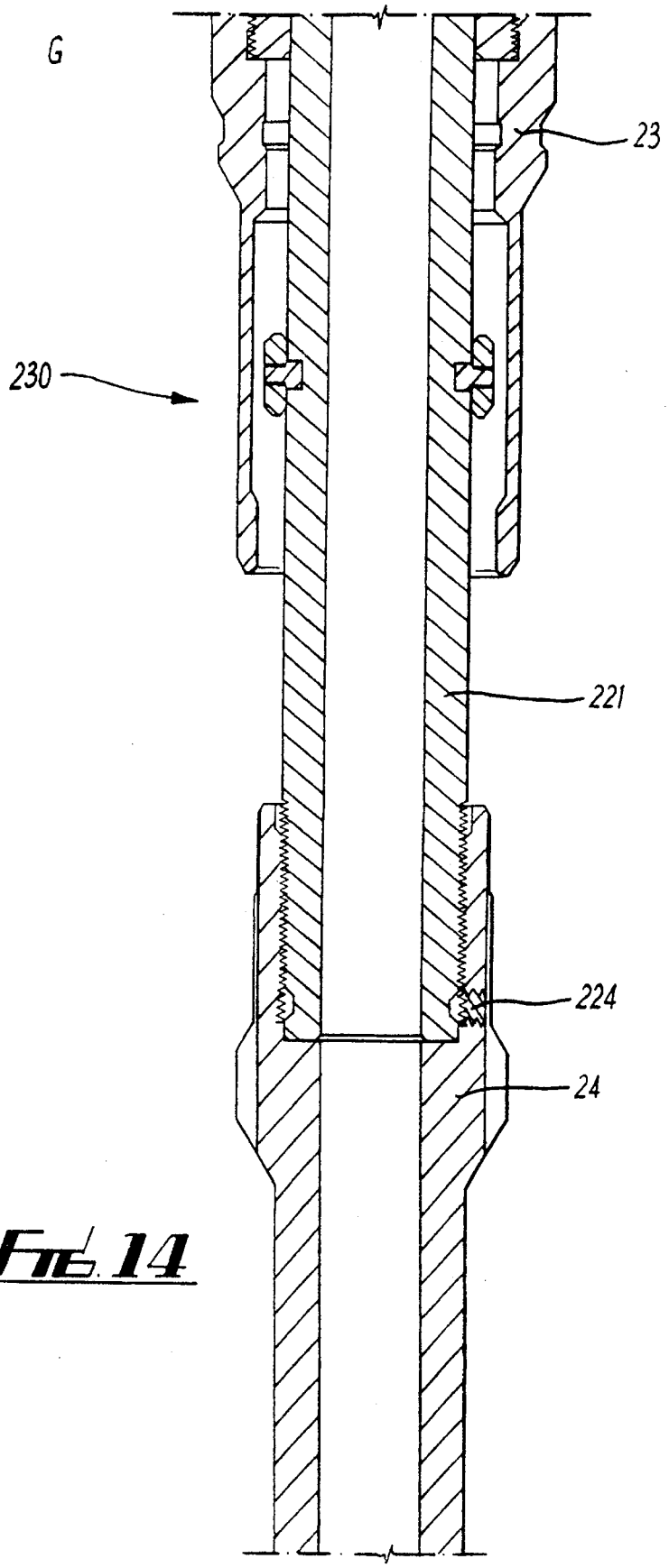
FIG. 14 is an enlargement of the section marked "G" in FIG. 7.

The function of the compression shaft 221 is essentially similar in function to the function of the lower end of the screw housing 19 in FIG. 1 and the drive sleeve 227 and compression shaft 221 are attached to a running tool 230 (see FIGS. 7, 13 and 14) which is essentially the same in operation as the running tool 60 shown in FIGS. 1, 4 and 5 and described above. Items which are common between the tool 230 and tool 60 have been given the same reference numerals. The drive sleeve 227 performs the same function as the drive sleeve 20 in the apparatus shown in FIGS. 1 to 5 and operation of the tool 100 is similar to the operation of the load amplifier 50 shown in FIGS. 1 to 5 and described above.

However, one of the advantages of the apparatus shown in FIGS. 7 to 15 is that by using two lead screws 109, 217 and bearing nuts 114 and 215, frictional losses within the tool are reduced and this permits a more efficient mechanical advantage to be obtained. The tool described in FIGS. 1 to 5 uses one lead screw with one associated bearing nut and co-operating threads are used instead of the second lead screw and second bearing nut of the second example of the invention described above and shown in FIGS. 7 to 15.

Modifications and improvements may be incorporated without departing from the scope of the invention.

I claim:

1. Apparatus for amplifying a load applied by a wireline to a tool in a borehole comprising a housing, a first coupling device to couple the wireline to the apparatus, a second coupling device to couple the tool to the apparatus , the second coupling device being movably mounted within the housing, a transmission mechanism interconnecting the first and second coupling devices, the transmission mechanism permitting a mechanical advantage and comprising a first linearly movable member coupled to the first coupling device and a second linearly movable member coupled to the second coupling device, the first and second members, being interconnected by a rotatable member such that movement of the first member rotates the rotatable member to move the second member, the movement of the second member being less than the movement of the first member to generate a mechanical advantage.

2. Apparatus according to claim 1, wherein the rotatable member is coupled to the first member by a first mounting mechanism, the first mounting mechanism comprising a first helical formation formed on one of the rotatable member and the first member.

3. Apparatus according to claim 2, wherein the first mounting mechanism also includes a first bearing device on the other of the rotatable member and the first member which engages with the first helical formation.

4. Apparatus according to claim 1, wherein the rotatable member and the second member are coupled to each other by a second coupling mechanism comprising a second helical formation on one of the rotatable member and the second member.

5. Apparatus according to claim 4, wherein the second coupling mechanism also includes a second bearing device on the other of the second member and the rotatable member which engages with the second helical formation.

6. Apparatus for amplifying a load applied by a wireline to a tool in a borehole comprising a housing, a first coupling device to couple the wireline to the apparatus, a second coupling device to couple the tool to the apparatus, the second coupling device being movably mounted within the housing; a transmission mechanism interconnecting the first and second coupling devices, the transmission mechanism permitting a mechanical advantage and comprising a first linearly movable member coupled to the first coupling device and a second linearly movable member coupled to the second coupling device, the first and second members, being interconnected by a rotatable member such that movement of the first member rotates the rotatable member to move the second member, the movement of the second member being less than the movement of the first member to generate a mechanical advantage; the transmission mechanism also comprising a first mounting mechanism to couple the rotatable member to the first member, and a second mounting mechanism to couple the rotatable member to the second member, the first mounting mechanism comprising a first helical formation on one of the rotatable member and the first member, and the second mounting mechanism comprising a second helical formation on one of the rotatable member and the second member.

7. Apparatus according to claim 6, wherein the pitch of the first helical formation is greater than the pitch of the second helical formation.

8. Apparatus according to claim 6, wherein the first mounting mechanism also includes a first bearing device which engages the first helical formation, and the second mounting mechanism also includes a second bearing device which engages the second helical formation.

* * * * *